US011584491B2

(12) United States Patent
Grice

(10) Patent No.: US 11,584,491 B2
(45) Date of Patent: Feb. 21, 2023

(54) COOPER RIVER DIVE SPIKE—A MULTI-FUNCTIONAL DIVE TOOL

(71) Applicant: Keith D. Grice, Leesville, SC (US)

(72) Inventor: Keith D. Grice, Leesville, SC (US)

( * ) Notice: Subject to any disclaimer, the term of this patent is extended or adjusted under 35 U.S.C. 154(b) by 385 days.

(21) Appl. No.: 16/839,620

(22) Filed: Apr. 3, 2020

(65) Prior Publication Data

US 2021/0309328 A1 Oct. 7, 2021

(51) Int. Cl.
*B63C 11/02* (2006.01)
*B63C 11/52* (2006.01)
*G09F 23/00* (2006.01)

(52) U.S. Cl.
CPC ..... *B63C 11/02* (2013.01); *B63C 11/52* (2013.01); *G09F 23/00* (2013.01)

(58) Field of Classification Search
CPC ..... B63C 11/02; B63C 11/52; G09F 23/00; G09F 23/0066; F41B 15/06
USPC ..... 405/185, 186
See application file for complete search history.

(56) References Cited

U.S. PATENT DOCUMENTS 1,415,887 A * 5/1922 Mcwilliams ..... F25C 5/043 30/164.5
2,970,399 A * 2/1961 Frohlich ..... F41B 13/00 43/6
2,981,026 A * 4/1961 Wedrall ..... F41B 13/00 604/130
3,850,408 A * 11/1974 Shelnick ..... A01K 81/04 251/290
4,631,770 A * 12/1986 Goldberg ..... B25F 1/02 463/47.4
4,720,933 A * 1/1988 Stude ..... A01K 81/00 43/6
4,899,415 A * 2/1990 Wheeler ..... F41A 29/02 81/177.1
5,033,142 A * 7/1991 Templeton ..... B63C 11/52 224/222
5,484,440 A * 1/1996 Allard ..... A61B 17/8886 411/407
5,487,203 A * 1/1996 Brach, Jr. ..... B25G 1/00 40/586
5,566,858 A * 10/1996 Ducker, III ..... A01K 81/06 239/566
9,829,267 B1 * 11/2017 Nikolic ..... A01K 81/06
2004/0099300 A1 * 5/2004 Warren ..... E04H 15/62 135/118
2009/0169308 A1 * 7/2009 Pajas ..... B63C 11/52 405/185

(Continued)

FOREIGN PATENT DOCUMENTS

GB 2445191 A * 7/2008 ..... F41B 13/00

*Primary Examiner* — Frederick L Lagman
(74) *Attorney, Agent, or Firm* — Melissa B. Neely

(57) ABSTRACT

The present invention is a multi-functional dive tool designed for use by underwater or scuba divers, in particular divers that do so in rivers. The tool is a handheld metal spike designed to be utilized as a personal anchor or stabilizer when diving in water subject to strong currents. The tool has a pointed end to assist in pushing the spike into the river, ocean or lake bed. Unlike the prior art, the dive spike is constructed of materials with sufficient strength and weight that it can anchor the diver. The tool may also be used for a stand for cameras or lights, an anchor or pivot point for search lines, or an animal deterrent among other uses.

5 Claims, 3 Drawing Sheets

(56) References Cited

U.S. PATENT DOCUMENTS

| | | | | |
|---|---|---|---|---|
| 2013/0055620 | A1* | 3/2013 | Estabrook | F41B 13/10<br>43/4.5 |
| 2018/0073833 | A1* | 3/2018 | Marquez | F41B 15/06 |

* cited by examiner

COOPER RIVER DIVE SPIKE—A MULTI-FUNCTIONAL DIVE TOOL

CROSS REFERENCE TO RELATED APPLICATIONS

Not Applicable

STATEMENT REGARDING FEDERALLY SPONSORED RESEARCH OR DEVELOPMENT

This invention was not made by an agency of the United States Government nor under a contract with an agency of the United States Government.

THE NAME OF THE PARTIES TO JOINT RESEARCH AGREEMENT

Not Applicable.

INCORPORATION BY REFERENCE OF MATERIAL SUBMITTED ON A COMPACT DISC OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVENTOR

Not Applicable

BACKGROUND OF THE INVENTION

Field of the Invention

Scuba diving is a form of underwater swimming where the swimmer/diver uses a self-contained underwater breathing apparatus (scuba) to breath underwater. Scuba diving may be done either recreational or professionally, with professional diving involved in scientific exploration, public safety and military applications. Scuba diving, or diving, may be done in any body of water that is sufficiently deep. Although most think of diving being done in the ocean, it is also common for diving in lakes and rivers.

The present invention is a multi-functional tool for divers that can be used in any body of water but was developed with a river diver as the primary consideration.

Description of Related Art

U.S. Pat. No. 9,829,267—Scuba Diving Accessory, Monopod, Sling, Fishing Spear, Lobster Tickling Rod, Eel Rattle, Signaling Device for Other Divers (issued Nov. 28, 2017 to Nikolic) is for a light-weight telescoping device for spear fishing that can be used for other purposes as listed in the invention title.

U.S. Pat. No. 4,720,933—Diving Spear and Sling Fastening Apparatus Therefor (issued Jan. 26, 1988 to Stude) is for a fishing spear and a method and apparatus to attach a thrusting sling to the spear shaft.

BRIEF SUMMARY OF THE INVENTION

The present invention is a multi-functional dive tool designed for use by underwater or scuba divers, in particular divers that do so in rivers. The tool is a handheld metal spike designed to be utilized as a personal anchor or stabilizer when diving in water subject to strong currents. The tool may also be used for a stand for cameras or lights, an anchor or pivot point for search lines, or an animal deterrent among other uses.

DETAILED DESCRIPTION OF THE INVENTION

Figure 1:
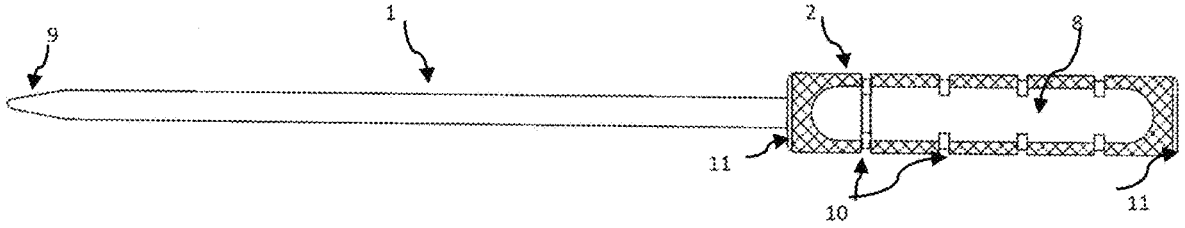
FIG. 1 is a top view of the device showing the spike (1) with pointed tip (9), the handle (2) with a flat surface (8) for product logo and name, grooves (10) for gripping and chamfers (11) to eliminate sharp corners.

The present invention is a multi-functional dive tool designed for use by underwater or scuba divers, in particular divers that do so in rivers. The tool is a handheld metal spike designed to be utilized as a personal anchor or stabilizer when diving in water subject to strong currents. The tool has a pointed end to assist in pushing the spike (1) into the river, ocean or lake bed. Unlike the prior art, the dive spike is constructed of materials with sufficient strength and weight that it can anchor or stabilize the diver in a current. The tool may also be used for a stand for cameras or lights, an anchor or pivot point for search lines, or an animal deterrent among other uses.

The tool consists of a stainless steel rod/spike (1) and a brass handle (2). The stainless steel rod (1) is pressed into the handle (2) and secured with a locking pin (4) that is drilled through both the handle (2) and the rod (1).

Overall length of the invention may range from 13 to 36 inches. The handle (2) can vary in length from 5 to 8 inches with the exposed portion of the spike (1) varying from 8 to 24 inches in length. Diameter of the handle (2) varies from % to 1¼ inches with rod (1) varying between ¼ to ¼ inches in diameter.

In the preferred embodiment of the invention the rod (1) is 1 11/4 inches in length with 10 inches exposed and ⅜ inches in diameter that at the end of the rod (1) opposite the handle (2) is subjected to a 10 degree taper to form a point (9). The rod (1) is constructed of 303 stainless steel in the preferred embodiment of the invention.

The handle (2) of the preferred embodiment of the invention is 5 inches in length with a 1 inch diameter. The handle (2) is constructed of brass. The handles (2) surface has been knurled to provide a textured grip. Four grooves (10) are evenly spaced along the handle (2) to assist with gripping the handle (2). The grooves (10) are approximately ⅛ inch deep and ⅛ inch wide. Chamfers (11) are at either end of the handle (2) to eliminate sharp corners. The chamfers (11) are approximately 1/16 inches wide.

One side of the handle (2) has a ¼ inch wide flat milled surface (8) for printing the logo and/or name of the product for marketing purposes. The logo and/or name could be laser etched, printed or stamped onto the flat surface (8).

The preferred embodiment of the invention has a ¼ diameter inch hole (6) drilled horizontally through the handle (2) and a ¼ diameter threaded tap (5) drilled 1 inch deep into the center of the handle (2) at the handle's end opposite the spike (1). These holes (5, 6) are for accessories such as lanyards, clips, swivels, light mounts and camera brackets to be attached to the invention.

Although the preferred embodiment of the invention utilizes 303 stainless steel for the rod (1) it should be noted that the rod (1) could be constructed from other grades of stainless steel such as 301, 302, 304, 316 or 321 or other metal alloys. The preferred embodiment of the invention has the exposed portion of the rod (1) is 10 inches in length. In other embodiments of the invention, the exposed portion of the rod (1) is in the range of 8 to 24 inches in length and the diameter of the rod (1) can vary between ¼ to ¼ in diameter. One to two inches of the rod (1) is embedded into the handle (2). However, the rod (1) is not limited to the lengths and diameters specified herein.

The handle (2) in the preferred embodiment of the invention is constructed from 1 inch diameter brass stock and is 5 inches in length and a circular cylinder in shape. In other embodiment of the invention, the handle (2) could be other cylindrical shapes that circular such as hexagonal or octagonal. The handle (2) can also be constructed of other materials that brass such as bronze, stainless steel, a metallic alloy or plastic. In size the handle (2) may vary from 5 to 8 inches in length and % to 1¼ inches in diameter. Like the rod (1), the handle (2) is not limited to the lengths and diameters specified herein.

In the preferred embodiment of the invention the rod (1) is securely affixed to the handle (2) by means of a locking pin (4). It should be noted that other means could be utilized to secure the rod (1) and handle (2) together including welding or the use of adhesives depending upon the materials used to construct the rod (1) and the handle (2).

The dimensions of the locking pin (4), accessory holes (5, 6), gripping grooves (10) and chamfers (11) are not limited to the dimensions specified for the preferred embodiment of the invention. The dimensions of the aforementioned components of the invention may be varied in both number and dimensions.

Figure 2:
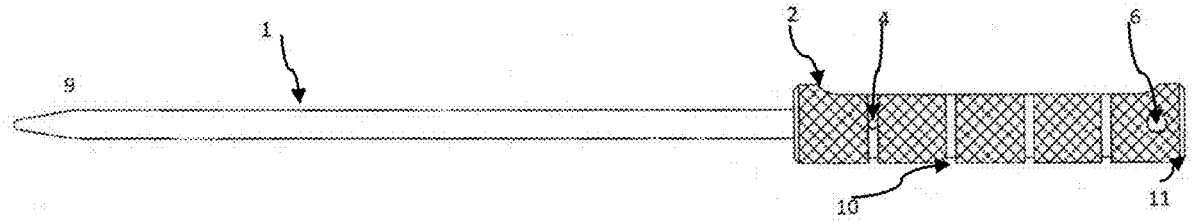
FIG. 2 is a side view of the tool showing the spike (1) with pointed end, the handle (2) with grooves (10) for gripping and chamfers (11). Also shown is the locking pin (4) drilled through the handle (2) and spike (1) and a small hole (6) drilled through the handle for the attachment of accessories.
Figure 3:
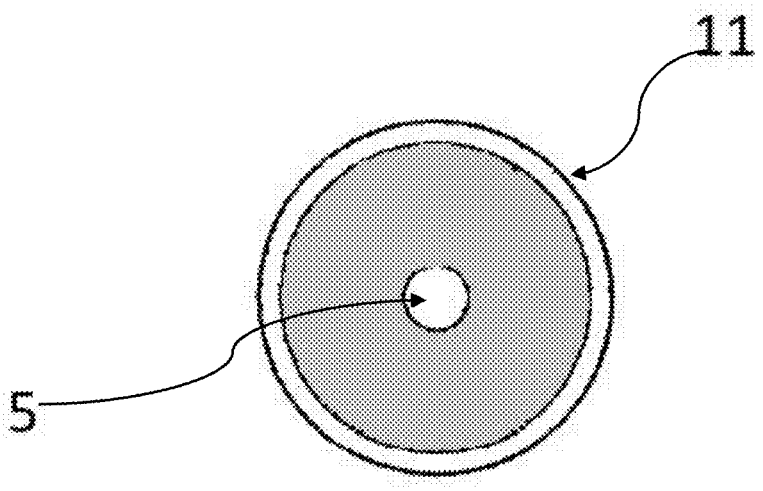
FIG. 3 is a view of the end of the handle (2) showing a threaded tap (5) drilled into the handle (2) for the mounting of accessories.

Potential CPC patent classifications for this invention:

B63C 11/00—Equipment for dwelling or working underwater; means for searching for underwater objects B63C 11/02—Divers' equipment B63C 11/52—Tools specially adapted for working underwater, not otherwise provided for The present invention described above and illustrated in FIGS. 1 through 3 is visualized as the preferred embodiment of the invention. It is envisioned that this invention may be embodied in many different forms and should not be construed as limited to the embodiments set forth herein. It will be understood by those skilled in the art that changes in forms and details may be made without departing from the spirit and scope of the present application. It is therefore intended that the present invention is not limited to the exact forms and details described and illustrated herein but falls within the scope of the appended claims.

The terminology used herein is for describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a stricture or feature that is disposed "adjacent" another feature may have portions that overlap or underlie the adjacent feature.

The invention claimed is:

1. An anchoring tool for underwater divers consisting of a 8 to 24 inch long rod with a diameter of ¼ to ½ inches constructed from 303 stainless steel affixed to a 5 to 8 inch long brass handle with a diameter of % to 1% inches where the rod has been inserted to a depth of 1 to 2 inches into the handle and further secured with a locking pin and where said rod has a 10 degree taper at the end opposite the handle to form a point and where said handle has a knurled surface with four or more grooves spaced along the handle's length and said handle is chamfered at either end and where said handle has a threaded hole tapped into the end of the handle for the attachment of accessories.

2. The device according to claim 1, where the rod is constructed from 301 stainless steel, 302 stainless steel, 304 stainless steel, 316 stainless steel, 321 stainless steel or a corrosion resistant metal alloy.

3. The device according to claim 1, where the handle is constructed from stainless steel, bronze, plastic or a corrosion resistant metal alloy.

4. The device according to claim 1, where the handle has a flat milled surface on one side for imprinting product name and/or logo.

5. The device according to claim 1, where the handle has a hole drilled horizontally through the width of the handle for the attachment of accessories.

* * * * *